US005755437A

United States Patent [19]

Ek

[11] Patent Number: 5,755,437

[45] Date of Patent: May 26, 1998

[54] ARRANGEMENT FOR CORRECTLY FEEDING THIN OBJECTS, SUCH AS BANKNOTES, CHEQUES, ETC.

[75] Inventor: Jan Olof Ek, Älvsjö , Sweden

[73] Assignee: De La Rue Inter Innovation AB, Sweden

[21] Appl. No.: 624,303

[22] Filed: Mar. 29, 1996

[30] Foreign Application Priority Data

Mar. 31, 1995 [SE] Sweden ..... 9501181

[51] Int. Cl.[6] ..... B65H 7/02

[52] U.S. Cl. ..... 271/227; 271/230; 271/254; 198/395; 198/460.1

[58] Field of Search ..... 271/228, 227, 271/229, 230, 254; 198/395, 601

[56] References Cited

U.S. PATENT DOCUMENTS

| | | | |
|---|---|---|---|
| 3,603,446 | 9/1971 | Mayey et al. | 271/227 |
| 4,757,903 | 7/1988 | Edin . | |
| 4,855,607 | 8/1989 | Eckl | 271/227 |
| 5,169,140 | 12/1992 | Werthe | 271/227 |
| 5,172,907 | 12/1992 | Kalisiak | 271/227 |

FOREIGN PATENT DOCUMENTS

| | | | |
|---|---|---|---|
| 0473884 | 3/1992 | European Pat. Off. . | |
| 0485167 | 5/1992 | European Pat. Off. . | |
| 0536885 | 4/1993 | European Pat. Off. . | |
| 0541260 | 5/1993 | European Pat. Off. . | |
| 0133148 | 7/1984 | Japan | 271/227 |
| 127347 | 5/1990 | Japan | 271/228 |
| 0026641 | 2/1991 | Japan | 271/228 |
| 267244 | 11/1991 | Japan | 271/228 |
| 277151 | 10/1992 | Japan | 271/228 |
| 001498 | 1/1994 | Japan | 271/227 |
| 85036689 | 8/1985 | Sweden . | |

*Primary Examiner*—H. Grant Skaggs
*Attorney, Agent, or Firm*—Lathrop & Gage

[57] ABSTRACT

An arrangement for feeding flat, thin objects, such as valuable documents in the form of banknotes, cheques, etc., along a transport path, including object straightening and repositioning means which straighten or reposition the objects as they pass sequentially along the transport path. The straightening means includes rotating driven object straightening rollers that lie briefly against the objects as the objects pass along the transport path. The straightening means includes two rotatable, driven straightening rollers, each mounted on a driving shaft and intended to lie in abutment with the objects. The straightening means further includes control means which causes the rollers to move in accordance with the deviation of respective objects from an intended correct position on the transport path.

6 Claims, 3 Drawing Sheets

ARRANGEMENT FOR CORRECTLY FEEDING THIN OBJECTS, SUCH AS BANKNOTES, CHEQUES, ETC.

CROSS REFERENCE TO EARLIER APPLICATION

Claiming benefit under 35 U.S.C. §119, this application is a U.S. counterpart of Swedish Patent Application No. 9501181-3, filed Mar. 31, 1995.

Incorporation by Reference

Swedish Patent Application No. 9501180-5 filed Mar. 31, 1995, and a U.S. counterpart thereof entitled "AN ARRANGEMENT FOR THE INFEED AND OUTFEED OF VALUABLE DOCUMENTS" and filed concurrently herewith, as application Ser. No. 08/623,971 which is not U.S. Pat. No. 5,680,935, are hereby incorporated herein by reference in their entirety, including drawings thereof.

FIELD OF THE INVENTION

The present invention relates to an arrangement for feeding flat, thin objects, such as valuable documents in the form of banknotes, cheques, etc., along a transport path, including straightening or aligning the objects as the objects pass sequentially along the transport path.

Description of the Related Art

It is known to straighten, for instance, banknotes as the banknotes pass from an infeed opening to a storage space. For instance, Swedish Patent No. 8,503,668-9 and U.S. Pat. No. 4,757,903 teach a straightening means which comprises a cylindrical drum and a straightening wheel in abutment therewith, the periphery of which is slotted to provide a plurality of fingers which are rigid or stiff in a peripheral direction and relatively slack in a radial direction. Although such straightening means are effective as the banknotes are transported in one and the same direction, those means have been found less effective when the banknotes are transported in both directions at high speeds.

What is needed is a straightening or aligning system wherein thin objects, such as banknotes, etc., can be effectively aligned as the thin objects are transported at high speeds in both directions along a transport path.

SUMMARY OF THE INVENTION

An improved arrangement is provided for straightening or aligning thin objects, such as banknotes, cheques, etc., as the thin objects are transported at high speeds in both directions along a transport path. The arrangement includes object straightening or aligning means comprising two rotatable and driven straightening or aligning rollers, each of which is mounted on a driving shaft and placed in abutting engagement with the thin objects as the thin objects are transported along the transport path. The system also includes control means which cause the rollers to be displaced according to deviations of respective ones of the thin objects from a desired correct or ideal position on the transport path.

Therefore, the principal objects and advantages of the present invention include effectively straightening or aligning thin objects, such as banknotes, etc., relative to a transport path as the thin objects are transported at high speeds in both directions along a transport path.

Other principal objects and advantages of the present invention will become apparent from the following description taken in conjunction with the accompanying schematic drawings wherein are set forth, by way of illustration and example, certain embodiments of the present invention.

DETAILED DESCRIPTION OF THE INVENTION

Figure 1:
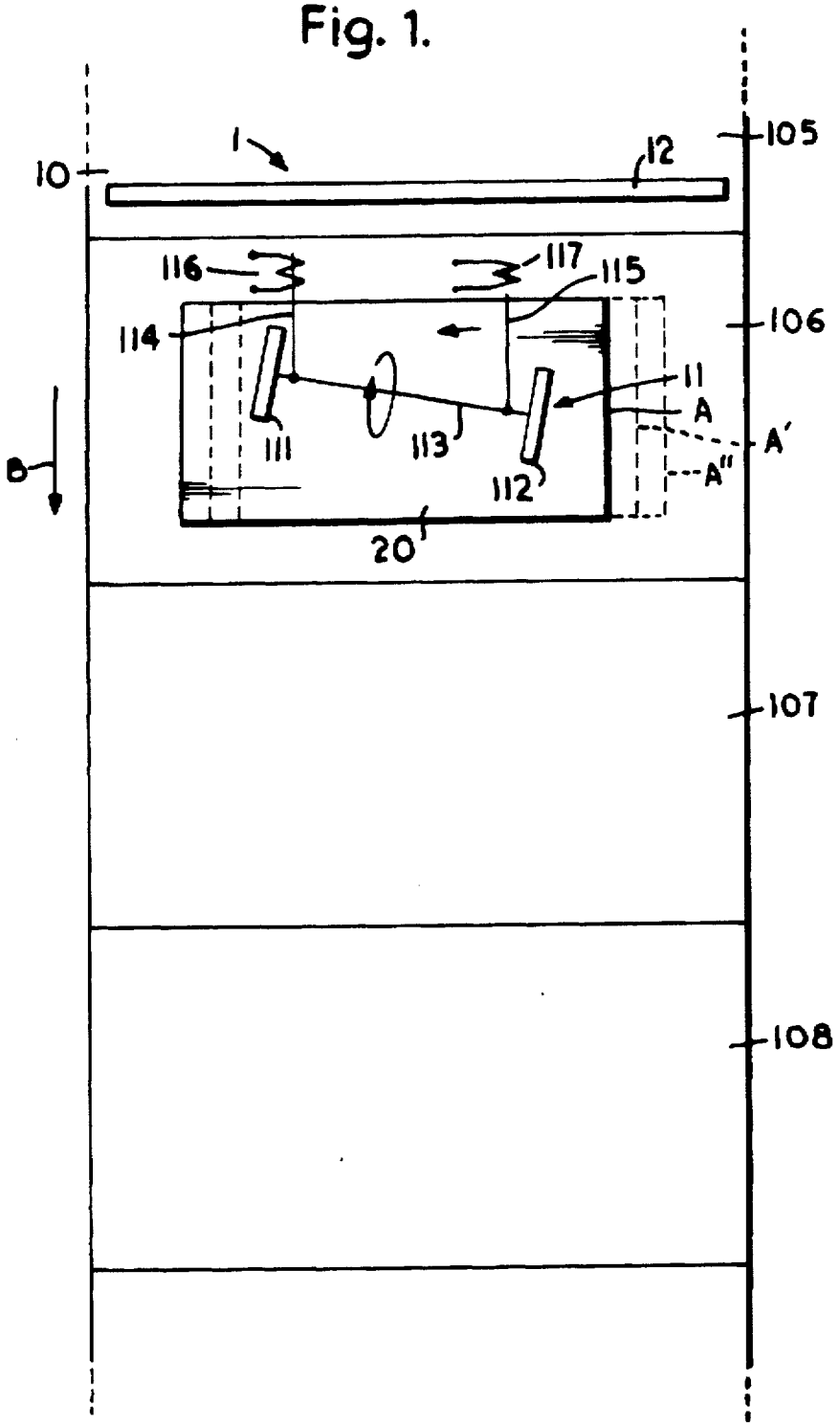
FIG. 1 is a schematic representation of an arrangement for correctly feeding thin objects, illustrating straightening means for correcting lateral positions of the objects on a transport path, according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for teaching one skilled in the art to variously employ the present invention in virtually any appropriately detailed structure.

The reference numeral 1 generally refers to an arrangement for correctly feeding thin objects, such as banknotes, cheques, etc., in accordance with the present invention, as schematically shown in FIGS. 1 through 6.

FIG. 1 illustrates a transport belt 10 which, for purposes of discussion, moves from top to bottom as indicated by the arrow designated by the letter "B". The belt 10 is viewed as being divided into a plurality of segments, such as the segments 105, 106, 107 108, etc., each of which is intended to receive an object 20, such as a banknote 20.

One of the banknotes 20, as properly or correctly placed on the segment 106, is shown in solid lines designated by the letter "A" in FIG. 1. Two positions in which the banknote 20 is improperly displaced laterally to the right in FIG. 1 are respectively indicated by the dashed lines designated by "A'" and "A"".

The belt 10, together with transport rollers thereof (not shown), forms a transport path between the two (unshown) storage reels. Each of the different segments 105–108, etc., is allocated an individual code so that as one of the banknotes 20 is detected in a particular one of the segments 105–108, etc., for instance a Swedish banknote valued at SEK 500, information relating to the respective one of the segments 105–108, etc., in which that particular banknote 20 is located in stored in a memory of a control unit 50. As a result, an accounting can be maintained of the quantity of the banknotes 20 that have been fed onto to the belt 10 and which of the segments 105–108, etc., contains each of the banknotes 20, including kind and denomination. A more detailed description of coded belts and associated control and storage means in provided in Swedish Patent Application No. 9,501,180-5, which is incorporated herein by reference.

It is to be understood that banknotes 20 may be transported in both directions between two storage reels (not shown) in order to infeed and outfeed banknotes 20 of different denominations. It is, therefore, desirable to keep track of which type of the banknotes 20 are present in respective ones of the segments 105–108, etc., of the coded belt 10. Thus, it is also important that the banknotes 20 be correctly or accurately positioned on the belt 10 so that intended ones of the banknotes 20 can be located on the coded belt 10 even though the banknotes 20 may be repeatedly conveyed backwards and forwards along the transport path of the belt 10.

The arrangement 1 includes banknote straightening and repositioning means 11, which function to straighten and correctly or accurately position any of the banknotes 20 that may be askew or may have moved out of desired position on the belt 10. The illustrated straightening or repositioning means 11 includes two rollers 111 and 112, preferably constructed of rubber and mounted on a common shaft 113. The shaft 113 can be displaced in the direction of travel of the belt 10 or angularly turned or rotated several degrees in a clockwise or counterclockwise direction, depending on whether a particular one of the banknotes 20 needs to be moved backwardly, forwardly or straightened. The shaft 113 is angularly-displaced or twisted horizontally by two relay-actuated control rods 114 and 115, each of which is actuated by a respective one of a pair of relays 116 and 117.

Arranged in a row transversely across the entire width of the belt 10 is a plurality of sensors 12, which together produce an output signal that indicates that a particular one of the banknotes 20 is correctly or improperly positioned on the belt 10 and which also indicates the direction that the banknote 20 needs to be manipulated in order to be accurately or correctly positioned. The output signal causes actuation of the relays 116 and 117, either one at a time, or both at once, depending on the manner in which the banknote 20 needs to be manipulated in order to accurately or correctly position the banknote 20.

If the sensors 12 detect that the banknote 20 is located too far to the right as the banknote 10 is transported in the direction "B", for example in position "A'", the relay 116 is actuated before the banknote 20 reaches the straightening means 11. When the banknote 20 arrives at the straightening means 11, it is subjected to a force component from the belt 10 that moves the banknote 20 in the direction "B" and also to a force component that moves the banknote 20 to the left on the belt 10, perpendicularly to the direction "B", thereby displacing the banknote 20 both forwardly and leftwardly, generally measured in millimeters, as the banknote 20 is transported through the rollers 111 and 112 of the straightening means 11. It is to be understood that the rollers 111 and 112 have the same peripheral speed as that of the transport belt 10. As the banknote 20 clears the rollers 111 and 112, the relay 116 is de-actuated thereby placing the straightening means 11 in readiness for straightening or repositioning following ones of the banknotes 20.

Should one of the banknotes 20 be positioned too far to the left, the relay 117 is actuated so as to adjust or displace the banknote 20 to the right, opposite to the direction aforedescribed.

Figure 2:
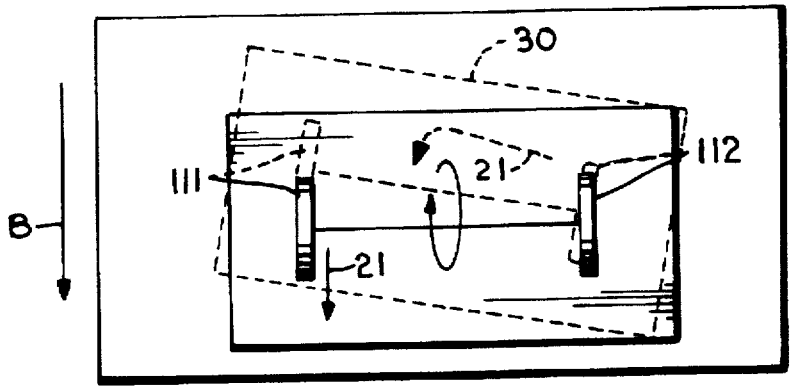
FIG. 2 is a schematic representation of the arrangement for correctly feeding thin objects, illustrating means for correcting the position of the objects by rotating the objects in a horizontal plane.

FIG. 2 illustrates a situation wherein one of the banknotes 20 approaching the plurality of sensors 12 is horizontally skewed, with the right short-side or end of the banknote 20 being before or ahead of the left short-side or end of the banknote 20, as indicated by the dashed line designated by the numeral 30. The relay 116 is actuated before the banknote 20 reaches the straightening means 11 and is de-actuated when the banknote 20 is approximately half way beneath the rollers 111 and 112. The de-actuation of the relay 116 causes the left end of the banknote 20 to be driven or displaced forwardly, generally measured in millimeters, relative to the right end of the banknote 20, as indicated by the arrows designated by the numeral 21 in FIG. 2.

More specifically, the shaft 113 carrying the rollers 111 and 112 is positioned obliquely as a result of the actuation of the relay 116, prior to the banknote 20 reaching the rollers 111 and 112. When the banknote 20 is located beneath the shaft 113, the relay 116 is de-actuated whereupon the shaft 113 returns to its normal position while entraining the banknote 20. The banknote 20 is thus acted upon by two forces, i.e. by a "normal" driving force exerted by the belt 10 and by a twisting, angularly displacing force exerted by the roller 111 on the shaft 113 as the shaft 113 moves or is re-oriented.

Similarly, when the left short-side or end of the banknote 20 arrives at the sensors 12 before the right short-side or end of the banknote 20, the banknote 20 will be straightened in the same manner as that previously described, but with the assistance of the relay 117.

Figure 3:
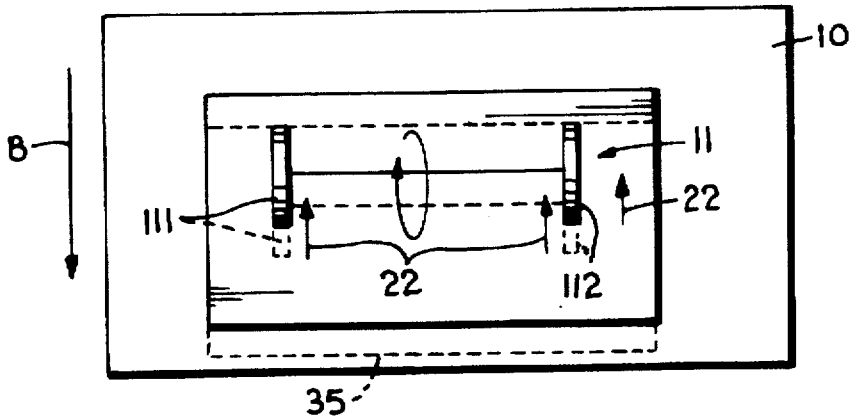
FIG. 3 is a schematic representation of the arrangement for correctly feeding thin objects, illustrating straightening means for correcting the positions of the objects in a rearward sense.

FIG. 3 illustrates a situation wherein one of the banknotes 20 on the belt 10 reaches the sensors 12 prematurely, as indicated by the dashed lines designated by the numeral 35. For this situation, both of the relays 116 and 117 are actuated simultaneously when the banknote 20 is spaced approximately halfway beneath the rollers 111 and 112 of the straightening means 11. As a result, the banknote 20 is displaced, generally measured in millimeters, horizontally and rearwardly on the belt 10, as indicated by the arrows designated by the numeral 22 in FIG. 3. The relays 116 and 117 are de-actuated when the banknote 20 is no longer beneath the rollers 111 and 112.

Figure 4:
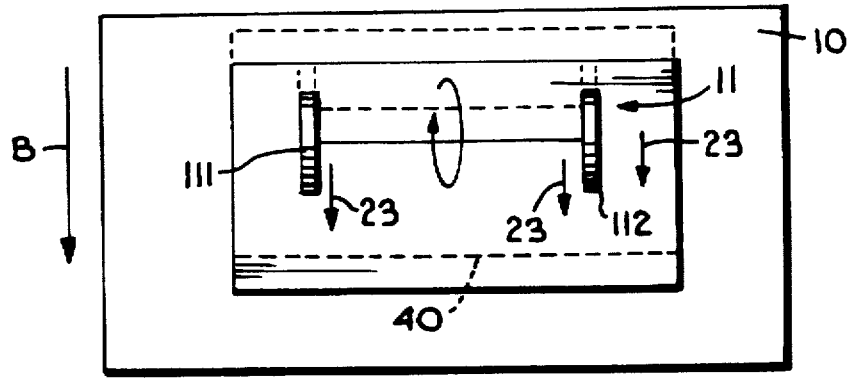
FIG. 4 is a schematic representation of the arrangement for correctly feeding thin objects, illustrating straightening means for correcting the positions of the objects in a forward sense, according to the present invention.

FIG. 4 illustrates a situation wherein one of the banknotes 20 on the belt 10 arrives late at the sensors 12, as indicated by the dashed lines designated by the numeral 40. For this situation, both of the relays 116 and 117 are actuated before the banknote 20 reaches the rollers 111 and 112 of the straightening means 11, thereby causing the shaft 113 and the rollers 111 and 112 to be withdrawn or displaced rearwardly. When the banknote 20 is located or spaced beneath the rollers 111 and 112, the relays 116 and 117 are de-actuated thereby causing the rollers 111 and 112 and the shaft 113 to return to their normal positions while entraining the banknote 20 forwardly, generally measured in millimeters, in the direction of travel "B" of the belt 10, as indicated by the arrows designated by the numeral 23 in FIG. 4. Thus, the control unit 50 functions to impart a translatory or translational displacement and a turning or twisting displacement to the straightening means 11.

Such control can be effected in other ways within the scope, nature and spirit of the present invention. For example, one method of effecting lateral displacement of one of the banknotes 20 is to laterally displace the shaft 113 magnetically.

Figure 5:
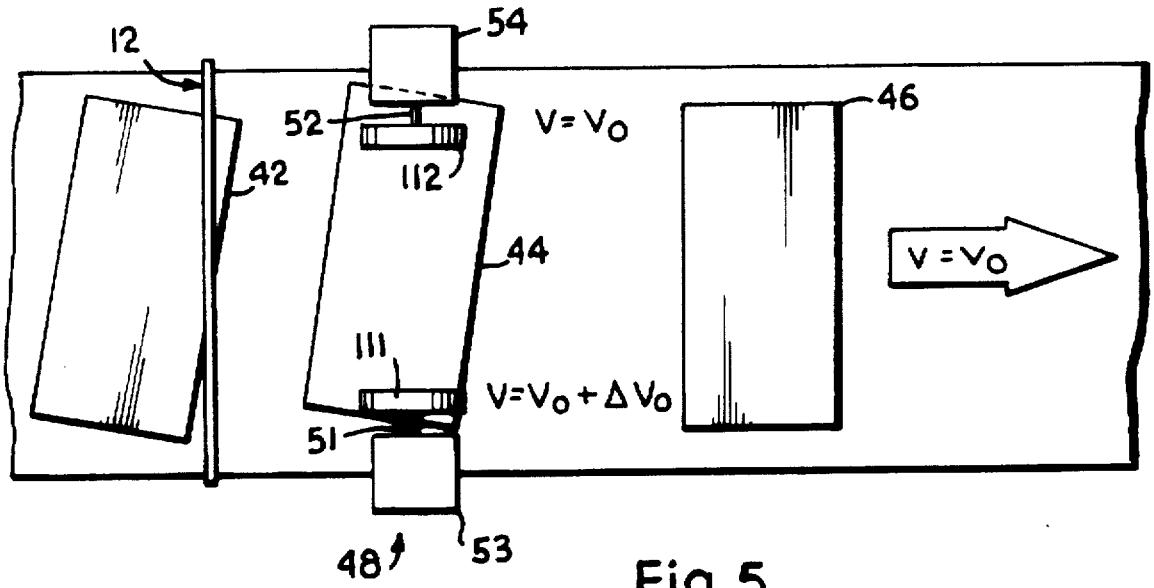
FIG. 5 is a schematic representation of a modified embodiment of the arrangement for correctly feeding thin objects, according to the present invention.

A modified or alternative manner of repositioning or straightening the banknotes 20 involves controlling and changing peripheral speeds of the individual rollers 111 and 112 of the straightening means 11 with stepping motors 53 and 54. One such straightening means 11 is illustrated in FIG. 5, wherein one of the banknotes 20 is shown in three different positions, designated by the numerals 42, 44 and 46, respectively. In position 42, the banknote 20 is shown passing the sensors 12, which detect the position of the banknote 20 on the belt 10. In position 44, the banknote 20 is being transported beneath straightening means 48 at a speed of $V=V_o$.

The straightening means 48 includes shafts 51 and 52, one for each of the rollers 111 and 112, and stepping motors 53 and 54, one for each of the shafts 51 and 52. The motors 53 and 54 are individually activated in accordance with the deviation of the banknote 20 from its intended correct or desired position on the belt 10. In the illustration of FIG. 5, the motor 53 is momentarily activated so that the shaft 51 and the roller 111 rotate at a higher or faster speed, corresponding to $V=V_o+\Delta V_o$, thereby turning or rotating the banknote 10 into desired position 46, as illustrated in FIG. 5.

Figure 6:
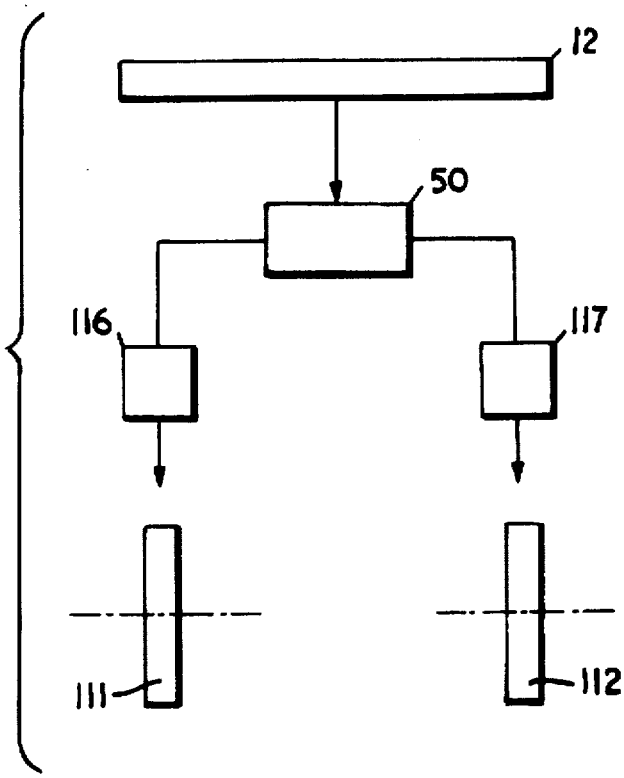
FIG. 6 is a block schematic representation of the arrangement for correctly feeding thin objects, according to the present invention.

FIG. 6 is a block schematic representation showing the sensor means 12 including the plurality of sensors 12 in a row across the entire width of the belt 10, the control unit 50 which is programmed to control the relays 116 and 117 or the stepping motors 53 and 54, in order to deliver impulses to the rollers 111 and 112 that are adapted to turn and/or position crooked or inaccurately placed ones of the banknotes 20 into their desired or correct positions.

It is to be understood that while certain forms of the present invention have been illustrated and described herein, it is not to be limited to the specific forms or arrangement of parts described and shown.

What is claimed and desired to be secured by letters patent is as follows:

1. An arrangement for feeding flat, thin objects, such as valuable documents in the form of banknotes, cheques, etc., along a transport path, comprising object straightening means which straighten the objects as they pass sequentially along the transport path, said straightening means including two rotatable object straightening and repositioning rollers which lie briefly against the objects as the objects pass along the transport path, wherein said two rollers are mounted on a common rotatable shaft which normally extends perpendicular to the direction of movement of the transport path; said straightening means further comprising control means for imparting to said shaft and said rollers a translatory movement and a twisting movement parallel to the transport path in accordance with deviation of respective objects from their intended correct positions on the transport path.

2. The arrangement according to claim 1, characterized in that said control means includes two relay means which act on said shaft close to ends thereof, wherein both said relay means are activated to effect said translatory movement, while only one said relay means is activated to effect said twisting movement, depending on the direction in which the respective object is to be twisted or turned in order to be positioned correctly.

3. A system for repositioning thin objects along a transport path, comprising repositioning means for aligning and rotating the objects as the objects pass sequentially along the transport path, said repositioning means including:

a) sensor means for determining angular and translational deviations of said objects from desired positions of the objects along the transport path;

b) a pair of rollers mounted on a common shaft normally extending perpendicularly to the direction of travel of the transport path, wherein said rollers are configured to be operatively placed in abutting engagement with the objects moving along the transport path; and c) control means for controlling displacements of said rollers in response to said angular and translational deviations determined by said sensor means,. wherein said control means includes means for controlling translational and rotational displacement of said shaft to thereby control said displacement of said rollers.

4. The system according to claim 3, wherein:

a) said control means includes a pair of relays, one connected to each end of said shaft, wherein a selected one of said pair of relays is actuated to effect rotational displacement of said shaft and wherein both of said pair of relays is actuated to effect translational displacement of said shaft.

5. An arrangement for feeding flat, thin objects, such as valuable documents in the form of banknotes, cheques, etc., along a transport path, comprising object straightening means which straighten the objects as they pass sequentially along the transport path, said straightening means including two object straightening and repositioning rollers which lie briefly against the objects as the objects pass along the transport path, wherein the straightening means further comprises control means which causes the rollers to move in accordance with the deviation of respective objects from an intended correct position on the transport path, characterized in that the two rollers are mounted on a common rotatable shaft which normally extends perpendicular to the direction of movement of the transport path; and in that the control means functions to impart to the shaft and the rollers a short translatory movement and a relatively slight twisting movement parallel with the transport path, in accordance with the deviation of respective objects from their intended correct positions in the transport path.

6. An arrangement according to claim 5, characterized in that the control means includes two relay means which act on the shaft close to the ends thereof, wherein both relay means are activated to effect said translatory movement, while only one relay means is activated to effect said twisting movement, depending on the direction in which the banknote is to be twisted or turned in order to be positioned correctly.

* * * * *

UNITED STATES PATENT AND TRADEMARK OFFICE

CERTIFICATE OF CORRECTION

PATENT NO. : 5,755,437
DATED : May 26, 1998
INVENTOR(S) : Jan Olof Ek

It is certified that error appears in the above-indentified patent and that said Letters Patent is hereby corrected as shown below:

Column 1, line 15, delete "not" and insert therefor --now--.

Signed and Sealed this

Eighteenth Day of August, 1998

Bruce Lehman

*Attest:*

BRUCE LEHMAN

*Attesting Officer*

*Commissioner of Patents and Trademarks*